US011835981B2

(12) United States Patent
Park

(10) Patent No.: US 11,835,981 B2
(45) Date of Patent: Dec. 5, 2023

(54) OPERATING DEVICE

(71) Applicant: KORTEK CORPORATION, Incheon (KR)

(72) Inventor: Moon Bae Park, Suwon-si (KR)

(73) Assignee: KORTEK CORPORATION, Incheon (KR)

( * ) Notice: Subject to any disclaimer, the term of this patent is extended or adjusted under 35 U.S.C. 154(b) by 157 days.

(21) Appl. No.: 17/599,827

(22) PCT Filed: Mar. 10, 2020

(86) PCT No.: PCT/KR2020/003329
§ 371 (c)(1),
(2) Date: Sep. 29, 2021

(87) PCT Pub. No.: WO2020/204379
PCT Pub. Date: Oct. 8, 2020

(65) Prior Publication Data

US 2022/0197326 A1 Jun. 23, 2022

(30) Foreign Application Priority Data

Apr. 4, 2019 (KR) ..... 10-2019-0039530
Aug. 5, 2019 (KR) ..... 10-2019-0094760

(51) Int. Cl.
*G05G 1/02* (2006.01)
*G05G 5/00* (2006.01)

(52) U.S. Cl.
CPC ..... *G05G 5/005* (2013.01); *G05G 1/02* (2013.01); *G05G 2505/00* (2013.01)

(58) Field of Classification Search
CPC ..... G05G 1/02; H01H 13/10; H01H 13/08; H01H 2003/145; H01H 3/20
See application file for complete search history.

(56) References Cited

U.S. PATENT DOCUMENTS

2019/0235563 A1* 8/2019 Mäkelä ..... G05G 1/02

FOREIGN PATENT DOCUMENTS

| | | | |
|---|---|---|---|
| JP | 2003-308756 A | | 10/2003 |
| JP | 2016207295 A | * | 12/2016 |
| JP | 2017-012636 A | | 1/2017 |
| KR | 10-2005-0010308 A | | 1/2005 |

(Continued)

OTHER PUBLICATIONS

EPO Translation of the Description of KR 20050010308 A, Choi, Jan. 27, 2005. (Year: 2023).*

(Continued)

*Primary Examiner* — Daniel D Yabut
(74) *Attorney, Agent, or Firm* — Schmeiser, Olsen & Watts, LLP

(57) ABSTRACT

Provided is an operating device comprising: an operation part which is inserted into an insertion hole portion of a glass part and has a locking protrusion portion having a protruding shape on the side surface thereof; and a locking rotation part which is disposed in a position opposite to the side surface of the operation part so as to allow or lock the movement of the locking protrusion portion, the locking rotation part comprising: a frame part having an inner hole portion into which the operation part is inserted; and a hollow hole part rotatably disposed in the frame part and communicating with the inner hole portion.

3 Claims, 5 Drawing Sheets

(56) References Cited

FOREIGN PATENT DOCUMENTS

| | | | |
|---|---|---|---|
| KR | 20-0434973 | Y1 | 7/2006 |
| KR | 10-2014-0031761 | A | 3/2014 |
| KR | 10-1919603 | B1 | 11/2018 |

OTHER PUBLICATIONS

PCT International Search Report for PCT Application No. PCT/KR2020/003329, dated Jun. 18, 2020.

* cited by examiner

OPERATING DEVICE

CROSS-REFERENCE TO RELATED APPLICATIONS

This application claims priority to PCT Application No. PCT/KR2020/003329, having a filing date of Mar. 10, 2020, which claims priority to KR 10-2019-0094760, having a filing date of Aug. 5, 2019, and KR 10-2019-0039530, having a filing date of Apr. 4, 2019, the entire contents all of which are hereby incorporated by reference.

FIELD OF TECHNOLOGY

The following relates to an operating device, and more particularly, to an operating device that allows an operation part to be quickly and easily installed and disassembled.

BACKGROUND

In general, display units are installed in game devices, and operation parts are fixed to the display units. Push operation parts are connected to circuit boards by electrical wires, and as signals of the push operation parts are input to the circuit boards, specific functions are selected. Such push operation parts may fail due to impacts or the like.

However, in the conventional art, since the push operation part is fixed to the display unit, when repair is required due to a failure of the push operation part, operations of separating the entire display unit from the game device and then transporting the display unit to a repair company are required.

At the repair company, the operation part is repaired or replaced and then is sent to a client, and the display unit is reinstalled in the game device. Thus, maintenance costs and working time increase. Therefore, it is necessary to reduce this problem.

The background technology is disclosed in Korean Utility Model No. 20-0434973 (registered on Dec. 26, 2006, titled: Unmanned operating device of operation button of game console).

SUMMARY

An aspect relates to an operating device that allows an operation part to be quickly and easily installed and disassembled, thereby reducing maintenance costs.

An aspect of embodiments of the present invention provides an operating device including an operation part which is inserted into an insertion hole part of a glass part and has a protrusion-shaped restraint protrusion, a frame part having an inner hole part into which the operation part is inserted, and a locking rotation part which is rotatably installed in the frame part, has a hollow hole part communicating with the inner hole part, is installed at a position facing a side surface of the operation part, and allows or restricts movement of the restraint protrusion.

The frame part may include a first frame part installed in contact with the glass part, and a second frame part coupled to the first frame part with the locking rotation part interposed therebetween.

The locking rotation part may include a rotation body part that has the hollow hole part formed therein and is rotatably installed between the first frame part and the second frame part, an unlocking groove part that forms a concave groove portion inside the rotation body part facing the hollow hole part, and a knob member that extends outward from the rotation body part and is rotated by receiving an external force.

The rotation body part may be a plate material extending outward from the operation part in a band shape.

The operating device may further include a guide part which is installed in the rotation body part and the frame part to guide rotation of the rotation body part.

The guide part may include a guide groove part that forms an arc-shaped groove along an edge of the rotation body part, and a guide protrusion that protrudes from the frame part and is caught by an inner side of the guide groove part.

In an operating device according to embodiments of the present invention, an unlocking groove part is moved due to rotation of a locking rotation part to restrain movement of an operation part or easily release the restraint of the operation part, and thus maintenance costs can be reduced, and work time can also be also shortened.

Further, according to embodiments of the present invention, since only the operation part can be separated from a glass part and repaired or replaced, an operation of moving the glass part together with the operation part is omitted, and thus maintenance costs and work time for the operation part can be reduced.

BRIEF DESCRIPTION

Some of the embodiments will be described in detail, with reference to the following figures, wherein like designations denote like members, wherein.

DETAILED DESCRIPTION

Figure 1:
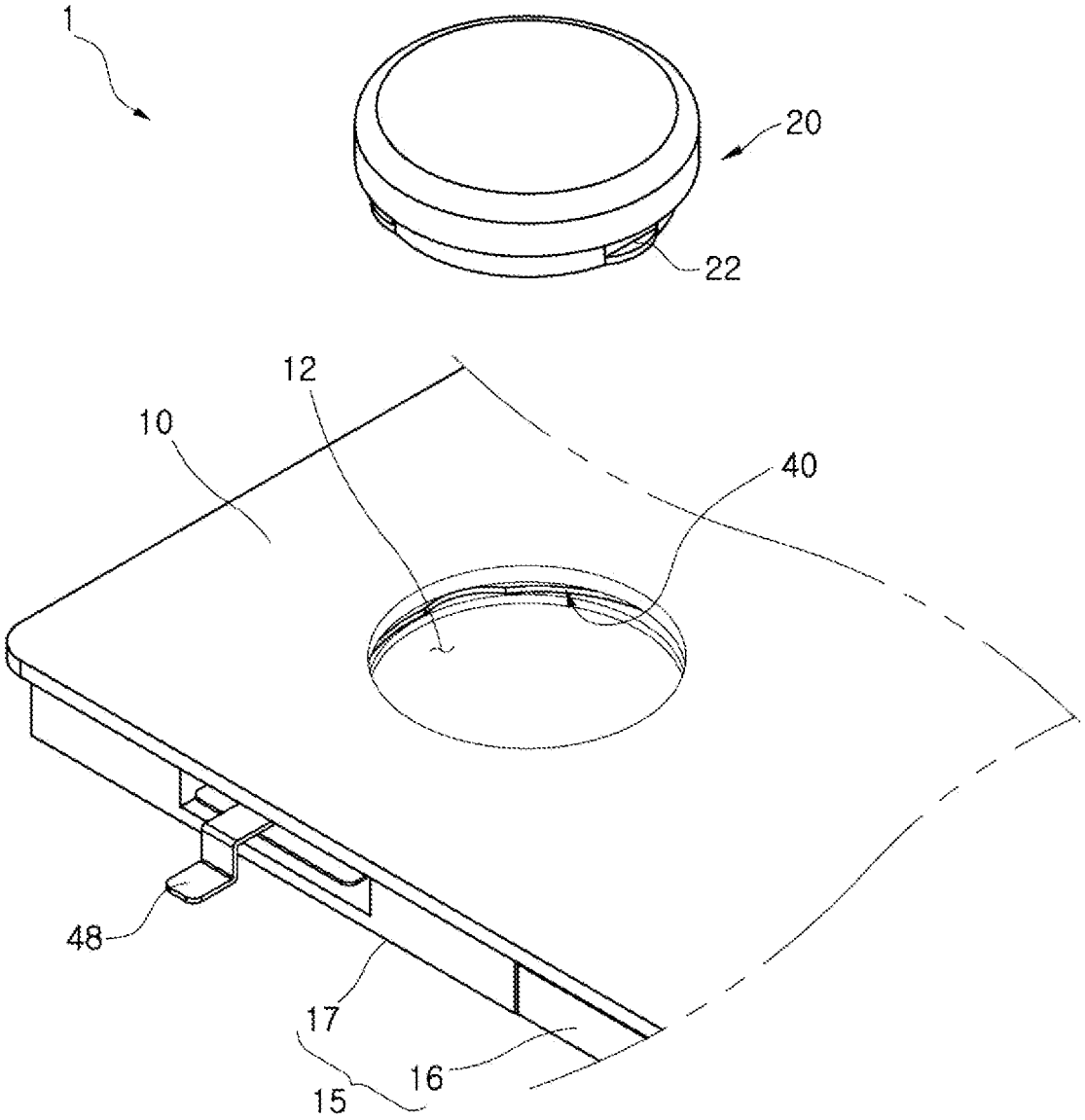
FIG. 1 is a perspective view illustrating a state in which an operation part is separated from an operating device according to one embodiment of the present invention.

Hereinafter, an operating device according to one embodiment of the present invention will be described with reference to the accompanying drawings. In this process, the thickness of lines or the size of components illustrated in the drawings may be exaggerated for clarity and convenience of description.

Further, terms described below are defined in consideration of functions in embodiments of the present invention and may change according to the intention or custom of a user or an operator. Therefore, definitions of these terms should be made based on the contents throughout the present specification.

Figure 2:
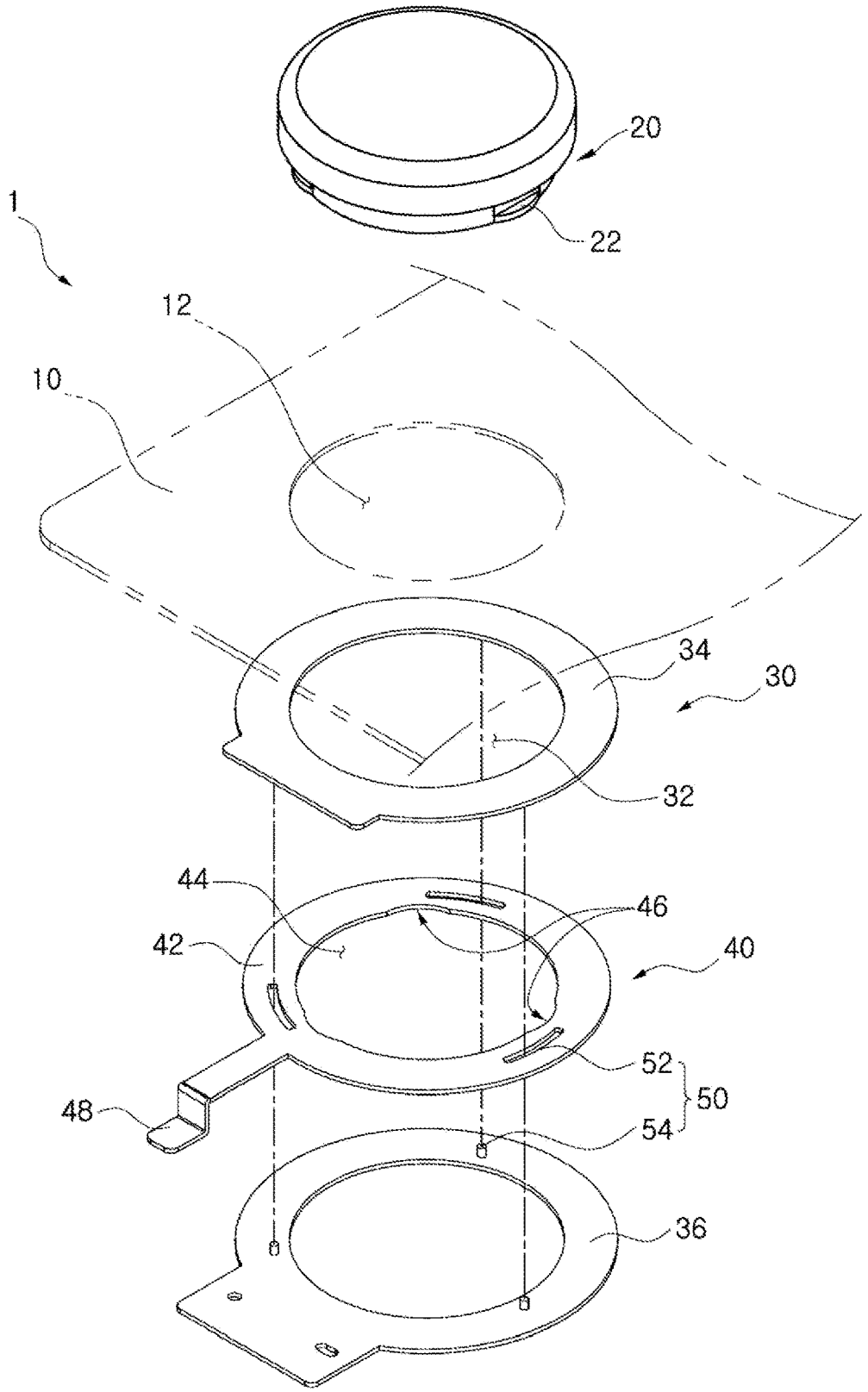
FIG. 2 is an exploded perspective view of the operating device according to one embodiment of the present invention.
Figure 3:
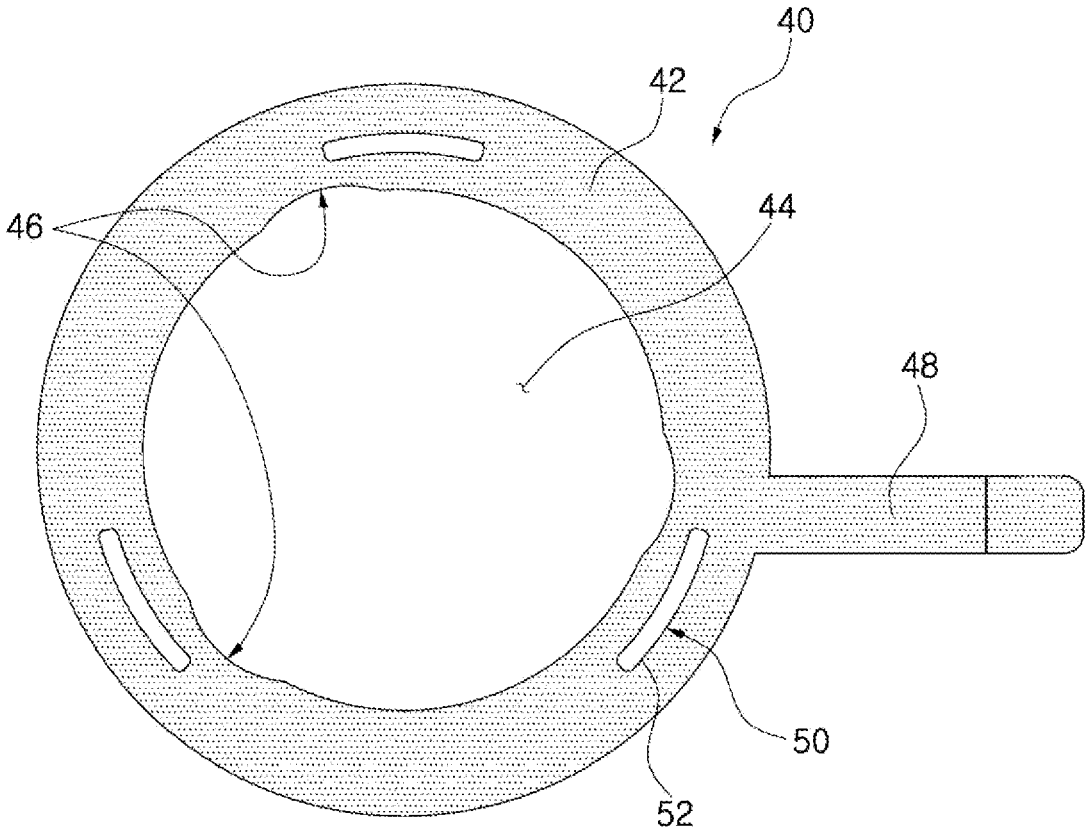
FIG. 3 is a plan view illustrating a locking rotation part according to one embodiment of the present disclosure.
Figure 4:
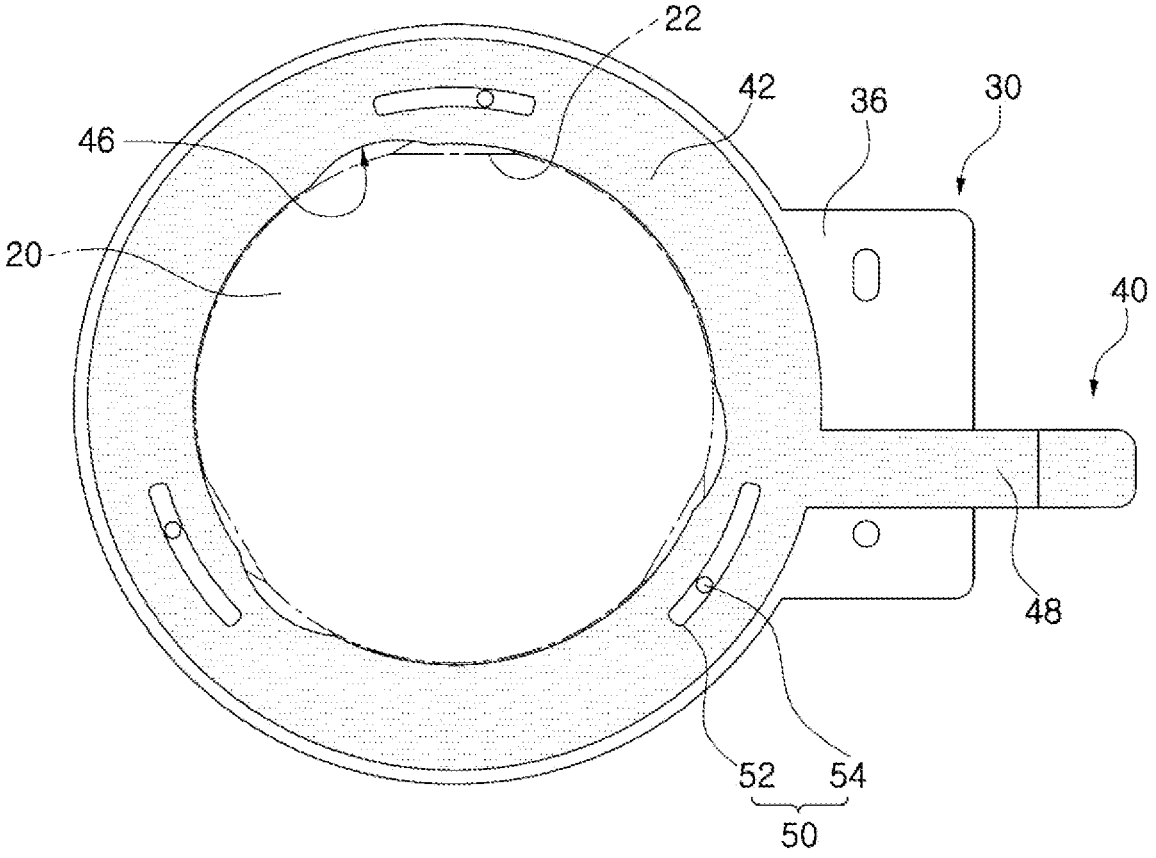
FIG. 4 is a view illustrating a state in which the locking rotation part restricts movement of an operation part according to one embodiment of the present invention.
Figure 5:
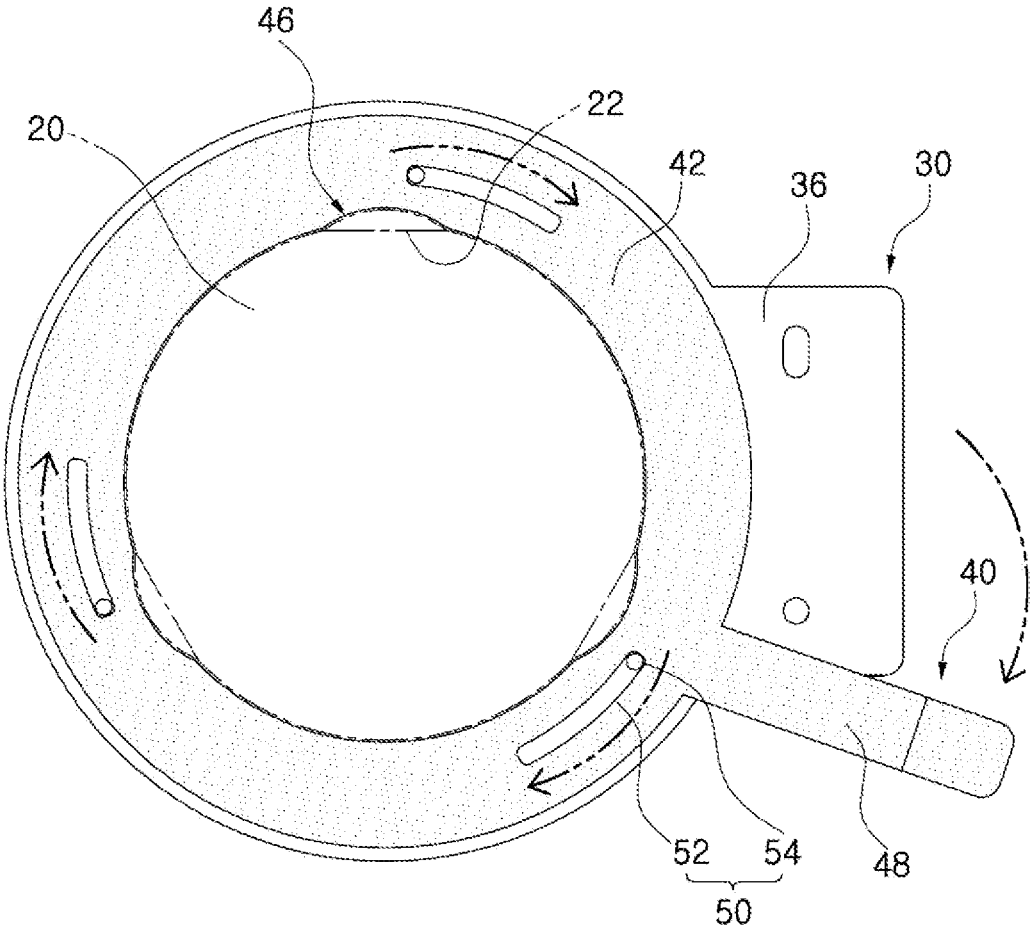
FIG. 5 is a view illustrating a state in which the operation part is unlocked by rotation of the locking rotation part according to one embodiment of the present invention.

FIG. 1 is a perspective view illustrating a state in which an operation part is separated from an operating device according to one embodiment of the present invention, FIG. 2 is an exploded perspective view of the operating device according to one embodiment of the present invention, FIG. 3 is a plan view illustrating a locking rotation part according to one embodiment of the present disclosure, FIG. 4 is a view illustrating a state in which the locking rotation part restricts movement of an operation part according to one embodiment of the present invention, and FIG. 5 is a view illustrating a state in which the operation part is unlocked by rotation of the locking rotation part according to one embodiment of the present invention.

As illustrated in FIGS. 1 to 5, an operating device 1 according to one embodiment of the present invention includes an operation part 20 which is inserted into an insertion hole part 12 of a glass part 10 and has a protrusion-shaped restraint protrusion 22 on the side surface thereof, a frame part 30 having an inner hole part 32 into which the operation part 20 is inserted, a locking rotation part 40 which is rotatably installed in the frame part 30, has a hollow hole part 44 communicating with the inner hole part 32, is installed at a position facing the side surface of the operation part 20, and allows or restricts movement of the restraint protrusion 22, and a guide part 50 which is installed in a rotation body part 42 and the frame part 30 to guide rotation of the rotation body part 42.

A display unit 15 includes a display panel 16 that outputs an image and a mounting housing part 17 that forms a space, in which the frame part 30 is installed, on one side of the display panel 16. The plate-shaped glass part 10 is disposed in front of the display unit 15 and the mounting housing part 17.

The glass part 10 is installed to be spaced apart from the display unit 15 to secure visibility. Further, the insertion hole part 12 is formed in the glass part 10 so that the operation part 20 is insertable thereinto. Since the insertion hole part 12 is formed in the same shape as the circumference of the operation part 20, rotation of the insertion hole part 12 is restricted while a body of the operation part 20 is inserted into the insertion hole part 12.

The operation part 20 is installed in the insertion hole part 12 of the glass part 10 installed in front of the display unit 15. Further, a stepped portion may be additionally formed at the circumference of the operation part 20 to limit the depth of insertion into the insertion hole part 12.

The operation part 20 is connected to a controller by electric wires and transmits an operation signal to the controller. The cross section of the operation part 20 and the insertion hole part 12 are formed in a circular shape, but embodiments of the present invention are not limited thereto, and the cross section of the operation part 20 and the insertion hole part 12 may be formed in a polygonal shape including a quadrangle or a triangle. The operation part 20 according to one embodiment is formed in a cylindrical shape.

The operation part 20 may be a button that has a circular cross section and extends vertically and may have a cross section having a polygonal shape including a quadrangle or the shape of the operation part 20 may be changed to one of various shapes such as an ellipse and a triangle.

Further, the restraint protrusion 22, with which the locking rotation part 40 is to be engaged, is formed around the operation part 20. The restraint protrusion 22 according to one embodiment is formed on the side surface of the operation part 20 facing the locking rotation part 40.

Therefore, when the locking rotation part 40 is engaged with the restraint protrusion 22, the operation part 20 does not escape from the insertion hole part 12 of the glass part 10.

The frame part 30 may be modified into any shape without departing from the technical spirit of having the inner hole part 32 into which the operation part 20 is inserted. The frame part 30 according to one embodiment includes a first frame part 34 which is installed in contact with the glass part 10 and a second frame part 36 which is coupled to the first frame part 34 with the locking rotation part 40 interposed therebetween.

The first frame part 34 is located below the glass part 10, and the locking rotation part 40 and the second frame part 36 are sequentially installed below the first frame part 34. The second frame part 36 is coupled to the first frame part 34, and a space in which the locking rotation part 40 is to be moved is formed between the first frame part 34 and the second frame part 36.

The inner hole part 32, in which the operation part 20 is to be installed, is provided inside the first frame part 34 and the second frame part 36.

The locking rotation part 40 is rotatably installed in the frame part 30, has the hollow hole part 44 communicating with the inner hole part 32, and may be modified in any shape without departing from the technical spirit of being installed at a position facing the side surface of the operation part 20. The locking rotation part 40 according to one embodiment includes the rotation body part 42, the hollow hole part 44, an unlocking groove part 46, and a knob member 48.

The rotation body part 42 has the hollow hole part 44 formed therein into which the operation part 20 is to be inserted and is rotatably installed between the first frame part 34 and the second frame part 36. The rotation body part 42 according to one embodiment is a plate material extending outward from the operation part 20 in a band shape and is rotated outside the operation part 20.

The inner diameter of the rotation body part 42 having the hollow hole part 44 is slightly greater than or equal to the outer diameter of the operation part 20. The rotation body part 42 is located above the restraint protrusion 22, and when the operation part 20 attempts to move upward, the restraint protrusion 22 is caught by the rotation body part 42 located above, and thus the operation part 20 can be prevented from escaping to the upper side.

In the restraint protrusion 22 according to one embodiment, a plurality of protrusions protrude in a circumferential direction along the side surface of the operation part 20.

The unlocking groove part 46 forms a concave groove portion inside the rotation body part 42 facing the hollow hole part 44. Further, a guide protrusion (not illustrated) may be vertically and additionally provided on the side surface of the operation part 20, and a guide groove into which the guide protrusion is to be inserted is formed inside the frame part 30. Thus, the rotation of the operation part 20 including the guide protrusion can be restrained.

The unlocking groove part 46 according to one embodiment is formed at a position facing the restraint protrusion 22, and the size and shape of the groove may be modified so that the restraint protrusion 22 can move up and down through the unlocking groove part 46.

That is, since the unlocking groove part 46, which is a concave groove, is formed in the rotation body part 42 facing the restraint protrusion 22 of the operation part 20, when the restraint protrusion 22 of the operation part 20 coincides with the unlocking groove part 46, the operation part 20 may move to the outside of the locking rotation part 40.

Since the protrusion-shaped restraint protrusion 22 is installed on the outer surface of the operation part 20 in a protruding shape, the locking rotation part 40 may be caught by the restraint protrusion 22 or spaced apart from the restraint protrusion 22.

The knob member 48 extends outward from the rotation body part 42 and is rotated by receiving an external force.

The knob member 48 according to one embodiment extends from the rotation body part 42 in a horizontal direction and extends outward from the mounting housing part 17.

The guide part 50 is installed in the frame part 30 together with the rotation body part 42 and may be formed in any shape without departing from the technical spirit of guiding the rotation of the rotation body part 42. The guide part 50 according to one embodiment includes a guide groove part 52 that forms an arc-shaped groove along an edge of the rotation body part 42 and a guide protrusion 54 that protrudes from the frame part 30 and is caught by the inner side of the guide groove part 52.

A plurality of guide groove parts 52 are provided along the rotation body part 42, and the guide protrusion 54 protruding upward from the second frame part 36 is inserted into the guide groove parts 52 to guide the stable rotation of the rotation body part 42.

Hereinafter, an operation state of the operating device 1 according to one embodiment of the present invention will be described in detail with reference to the accompanying drawings.

When the operation part 20 is unlocked, the knob member 48 protruding outward from the mounting housing part 17 is rotated. With the rotation of the knob member 48, the rotation body part 42 is also rotated, and the unlocking groove part 46 coincides with the restraint protrusion 22 of the operation part 20.

That is, in a state in which the restraint protrusion 22 of the operation part 20 is caught by the rotation body part 42 and thus the upward movement of the operation part 20 is restricted, the rotation body part 42 is rotated together with the knob member 48.

Since the unlocking groove part 46 of the locking rotation part 40 is located in a portion facing the restraint protrusion 22 of the operation part 20, when the operation part 20 is pulled out in an upward direction, the rotation body part 42 does not interfere with the operation part 20. Since the operation part 20 is unlocked, the operator may pull the operation part 20 out of the glass part 10 to perform maintenance work.

When the movement of the operation part 20 is restrained, the knob member 48 protruding outward from the mounting housing part 17 is rotated in an opposite direction. With the rotation of the knob member 48, the rotation body part 42 is also rotated, and since the rotation body part 42 is installed at a position facing the restraint protrusion 22 of the operation part 20, the upward movement of the restraint protrusion 22 is restrained, and accordingly the movement of the operation part 20 is also restrained.

As described above, according to embodiments of the present invention, the unlocking groove part 46 is moved by the rotation of the locking rotation part 40 to restrain the movement of the operation part 20 or easily release the restraint of the operation part 20, and thus maintenance costs can be reduced and working time can be shortened. Further, since only the operation part 20 may be separated from the glass part 10 and repaired or may be replaced, an operation of moving the glass part 10 together with the operation part 20 is omitted, and thus maintenance costs and work time of the operation part 20 can be reduced.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements. The mention of a "unit" or a "module" does not preclude the use of more than one unit or module.

The invention claimed is:

1. An operating device comprising:

an operation part which is inserted into an insertion hole part of a glass part and has a protrusion-shaped restraint protrusion;

a frame part having an inner hole part into which the operation part is inserted; and a locking rotation part which is rotatably installed in the frame part, has a hollow hole part communicating with the inner hole part, is installed at a position facing a side surface of the operation part, and allows or restricts movement of the restraint protrusion;

wherein the frame part includes:

a first frame part installed in contact with the glass part; and a second frame part coupled to the first frame part with the locking rotation part interposed therebetween;

wherein the locking rotation part includes a rotation body part that has the hollow hole part formed therein and is rotatably installed between the first frame part and the second frame part;

wherein the operating device further comprises a guide part which is installed in the rotation body part and the frame part to guide rotation of the rotation body part, and wherein the guide part includes:

a guide groove part that forms an arc-shaped groove along an edge of the rotation body part; and a guide protrusion that protrudes from the frame part and is caught by an inner side of the guide groove part.

2. The operating device of claim 1, wherein the locking rotation part further includes:

an unlocking groove part that forms a concave groove portion inside the rotation body part facing the hollow hole part; and a knob member that extends outward from the rotation body part and configured to rotate by receiving an external force.

3. The operating device of claim 2, wherein the rotation body part is a plate material extending outward from the operation part in a band shape.

* * * * *